US010587051B2

(12) United States Patent
Hsu

(10) Patent No.: US 10,587,051 B2
(45) Date of Patent: Mar. 10, 2020

(54) COMMUNICATION DEVICE

(71) Applicant: Wistron NeWeb Corp., Hsinchu (TW)

(72) Inventor: Chieh-Sheng Hsu, Hsinchu (TW)

(73) Assignee: WISTRON NEWEB CORP., Hsinchu (TW)

( * ) Notice: Subject to any disclaimer, the term of this patent is extended or adjusted under 35 U.S.C. 154(b) by 291 days.

(21) Appl. No.: 15/586,941

(22) Filed: May 4, 2017

(65) Prior Publication Data

US 2018/0226726 A1 Aug. 9, 2018

(30) Foreign Application Priority Data

Feb. 9, 2017 (TW) ..... 106104236 A

(51) Int. Cl.

| | |
|---|---|
| ***H01Q 19/10*** | (2006.01) |
| ***H01Q 9/28*** | (2006.01) |
| ***H01Q 5/385*** | (2015.01) |
| ***H01Q 7/00*** | (2006.01) |
| ***H01Q 5/378*** | (2015.01) |
| ***H01Q 9/04*** | (2006.01) |

(52) U.S. Cl.

CPC ..... *H01Q 19/108* (2013.01); *H01Q 5/385* (2015.01); *H01Q 9/285* (2013.01); *H01Q 5/378* (2015.01); *H01Q 7/00* (2013.01); *H01Q 9/0414* (2013.01)

(58) Field of Classification Search

CPC ..... H01Q 19/18; H01Q 19/192; H01Q 5/385; H01Q 9/0407; H01Q 9/0414; H01Q 19/10; H01Q 9/285; H01Q 15/00; H01Q 19/005; H01Q 19/19; H01Q 5/50

See application file for complete search history.

(56) References Cited

U.S. PATENT DOCUMENTS

| | | | | |
|---|---|---|---|---|
| 7,616,168 | B2 * | 11/2009 | Tillery | H01Q 1/246 343/797 |
| 2005/0190106 | A1 * | 9/2005 | Anguera Pros | H01Q 1/36 343/700 MS |
| 2009/0058731 | A1 * | 3/2009 | Geary | H01Q 9/0414 343/700 MS |
| 2010/0035539 | A1 * | 2/2010 | Yoshida | H01Q 1/2225 455/1 |
| 2015/0263426 | A1 * | 9/2015 | Hsu | H01Q 5/378 343/787 |

FOREIGN PATENT DOCUMENTS

| | | |
|---|---|---|
| CN | 104377455 A | 2/2015 |
| EP | 2 051 331 A1 | 4/2009 |

* cited by examiner

*Primary Examiner* — Ricardo I Magallanes

(74) *Attorney, Agent, or Firm* — McClure, Qualey & Rodack, LLP

(57) ABSTRACT

A communication device includes a wideband antenna, a reflector, and at least one metal loop. The wideband antenna is configured to cover an operation frequency band. The reflector is configured to reflect the radiation energy from the wideband antenna. The metal loop is positioned between the wideband antenna and the reflector. The distance between the wideband antenna and the reflector is shorter than 0.25 wavelength of a central frequency of the operation frequency band.

17 Claims, 16 Drawing Sheets

COMMUNICATION DEVICE

CROSS REFERENCE TO RELATED APPLICATIONS

This Application claims priority of Taiwan Patent Application No. 106104236 filed on Feb. 9, 2017, the entirety of which is incorporated by reference herein.

BACKGROUND OF THE INVENTION

Field of the Invention

The disclosure generally relates to a communication device, and more particularly, to a communication device and an antenna element therein.

Description of the Related Art

With the advancements being made in mobile communication technology, mobile devices such as portable computers, mobile phones, multimedia players, and other hybrid functional portable electronic devices have become more common. To satisfy consumer demand, mobile devices can usually perform wireless communication functions. Some devices cover a large wireless communication area; these include mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, and 2500 MHz. Some devices cover a small wireless communication area; these include mobile phones using Wi-Fi and Bluetooth systems and using frequency bands of 2.4 GHz, 5.2 GHz, and 5.8 GHz.

Since the interior space of a mobile device is limited, its antenna structure for wireless communication should have as small a size as possible. A conventional high directional antenna structure is often limited by there being a long distance between a radiation element and the reflection plane thereof, and thus such a structure cannot be applied to small mobile devices.

BRIEF SUMMARY OF THE INVENTION

In an exemplary embodiment, the disclosure is directed to a communication device including a wideband antenna, a reflector, and a first metal loop. The wideband antenna is configured to cover an operation frequency band. The reflector is configured to reflect the radiation energy from the wideband antenna. The first metal loop is disposed between the wideband antenna and the reflector. The distance between the wideband antenna and the reflector is shorter than 0.25 wavelength of the central frequency of the operation frequency band.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the purposes, features and advantages of the invention, the embodiments and figures of the invention are shown in detail as follows.

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". The term "substantially" means the value is within an acceptable error range. One skilled in the art can solve the technical problem within a predetermined error range and achieve the proposed technical performance. Also, the term "couple" is intended to mean either an indirect or direct electrical connection. Accordingly, if one device is coupled to another device, that connection may be through a direct electrical connection, or through an indirect electrical connection via other devices and connections.

Figure 1A:
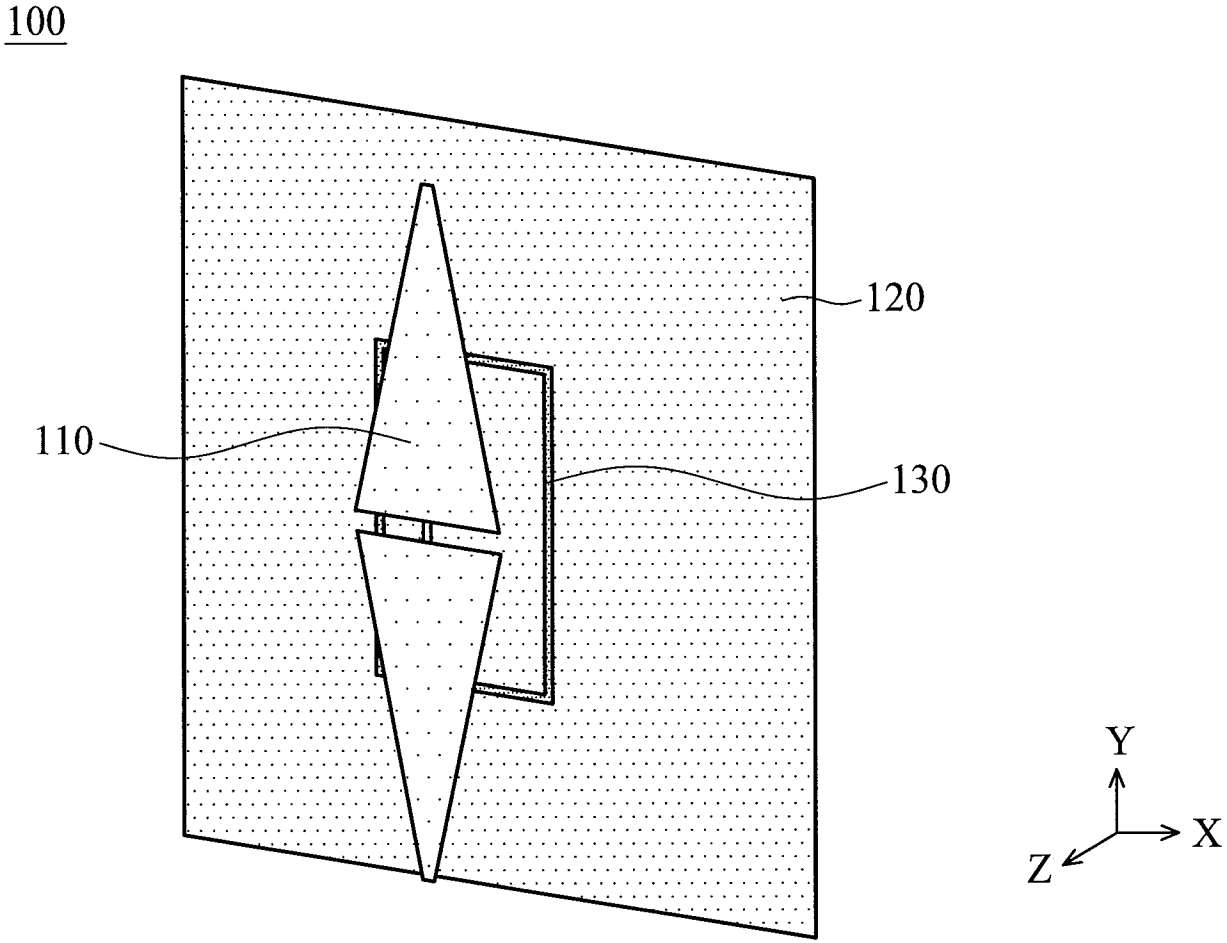
FIG. 1A is a perspective view of a communication device according to an embodiment of the invention.
Figure 1B:
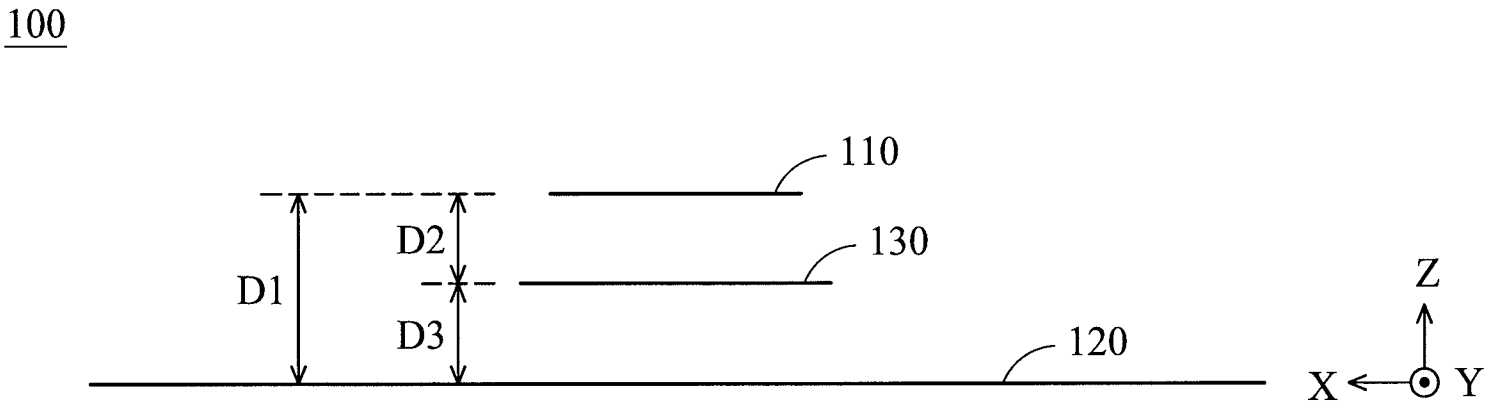
FIG. 1B is a side view of a communication device according to an embodiment of the invention.
Figure 1C:
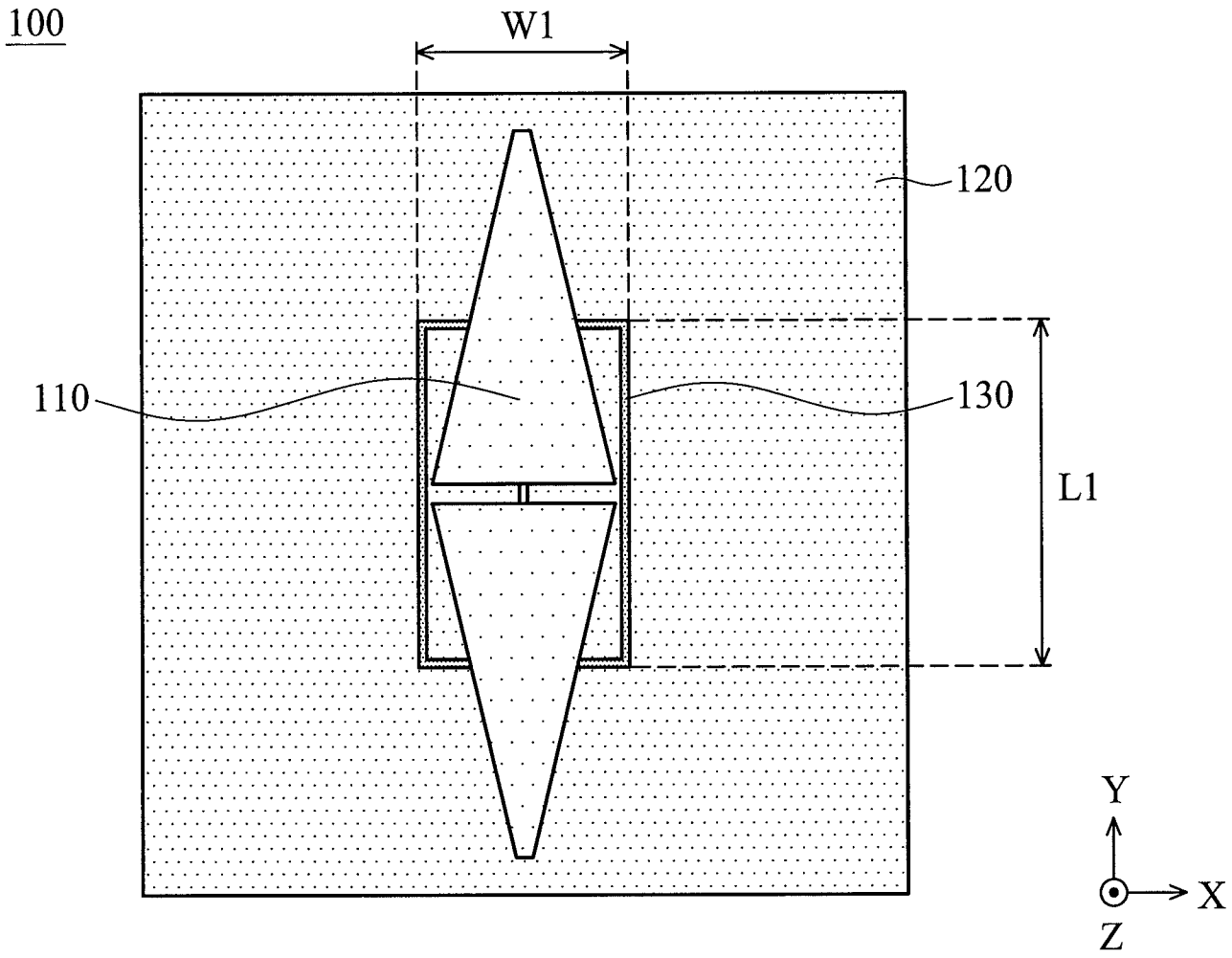
FIG. 1C is a top view of a communication device according to an embodiment of the invention.

FIG. 1A is a perspective view of a communication device 100 according to an embodiment of the invention. FIG. 1B is a side view of the communication device 100 according to an embodiment of the invention. FIG. 1C is a top view of the communication device 100 according to an embodiment of the invention. Please refer to FIG. 1A, FIG. 1B, and FIG. 1C together. The communication device 100 can be applied in a wireless access point or a mobile device. As shown in FIG. 1A, FIG. 1B, and FIG. 1C, the communication device 100 includes a wideband antenna 110, a reflector 120, and a first metal loop 130. In some embodiments, the wideband antenna 110, the reflector 120, and the first metal loop 130 are not electrically connected to each other. It should be understood that the communication device 100 may further include other components, such as a processor, an RF (Radio Frequency) module, a battery module, and a housing although they are not displayed in FIG. 1A, FIG. 1B, and FIG. 1C.

The wideband antenna 110 is configured to cover an operation frequency band. The shape and type of the wideband antenna 110 are not limited in the invention. For example, the wideband antenna 110 may be a diamond-shaped dipole antenna. In alternative embodiments, the wideband antenna 110 is implemented with a bowtie-shaped dipole antenna, or one of a monopole antenna, a loop antenna, and a patch antenna. The reflector 120 is configured to reflect the radiation energy from the wideband antenna 110. The reflector 120 may be a square metal plane. The first metal loop 130 is disposed between the wideband antenna 110 and the reflector 120, and is substantially parallel to the reflector 120. The first metal loop 130 is configured to reflect a portion of electromagnetic waves from the wideband antenna 110, and transmit the other portion of electromagnetic waves from the wideband antenna 110, thereby fine-tuning the phases of the electromagnetic waves and increasing the effective distance between the wideband antenna 110 and the reflector 120. With such a design, the distance D1 between the wideband antenna 110 and the reflector 120 can be shorter than 0.25 wavelength (λ/4) of a central frequency of the operation frequency band. It should be noted that the distance between the conventional reflective plane and the conventional antenna is generally equal to 0.25 wavelength (λ/4) of the central frequency of the operation frequency band. The design of the invention can significantly reduce the height of the wideband antenna 110 on the reflector 120. For example, after the first metal loop 130 is added, the distance D1 between the wideband antenna 110 and the reflector 120 can be reduced to 0.125 wavelength (λ/8) of the central frequency of the operation frequency band or shorter. Therefore, the invention is suitable for application in a variety of small-size base stations or mobile communication devices.

The element shapes and element sizes of the communication device 100 may be as follows. The distance D2 between the wideband antenna 110 and the first metal loop 130 is substantially equal to the distance D3 between the first metal loop 130 and the reflector 120. The first metal loop 130 may substantially have a hollow rectangular shape. That is, a small rectangular hollow portion is formed at the center of a large rectangular metal sheet. The length L1 of the first metal loop 130 is shorter than 0.5 wavelength (λ/2) of the central frequency of the operation frequency band. Specifically, the length L1 of the first metal loop 130 is from 0.25 to 0.4 wavelength of the central frequency of the operation frequency band, for example, it can be 0.25 wavelength. The width W1 of the first metal loop 130 is from 0.025 to 0.2 wavelength of the central frequency of the operation frequency band, for example, it can be 0.2 wavelength. The above ranges of element sizes are calculated according to many experiments and simulation results, and they can optimize the impedance matching of the wideband antenna 110 and the first metal loop 130. In some embodiments, the wideband antenna 110 has a total length of about 219.4 mm. The reflector 120 has a length of about 240 mm, and a width of about 240 mm. The first metal loop 130 has a length L1 of about 104.3 mm, and a width W1 of about 66.3 mm. The first metal loop 130 has a line width of about 2 mm. The distance D1 between the wideband antenna 110 and the reflector 120 is about 40 mm. The distance D2 between the wideband antenna 110 and the first metal loop 130 is about 19.3 mm. The distance D3 between the first metal loop 130 and the reflector 120 is about 20.7 mm.

Figure 2A:
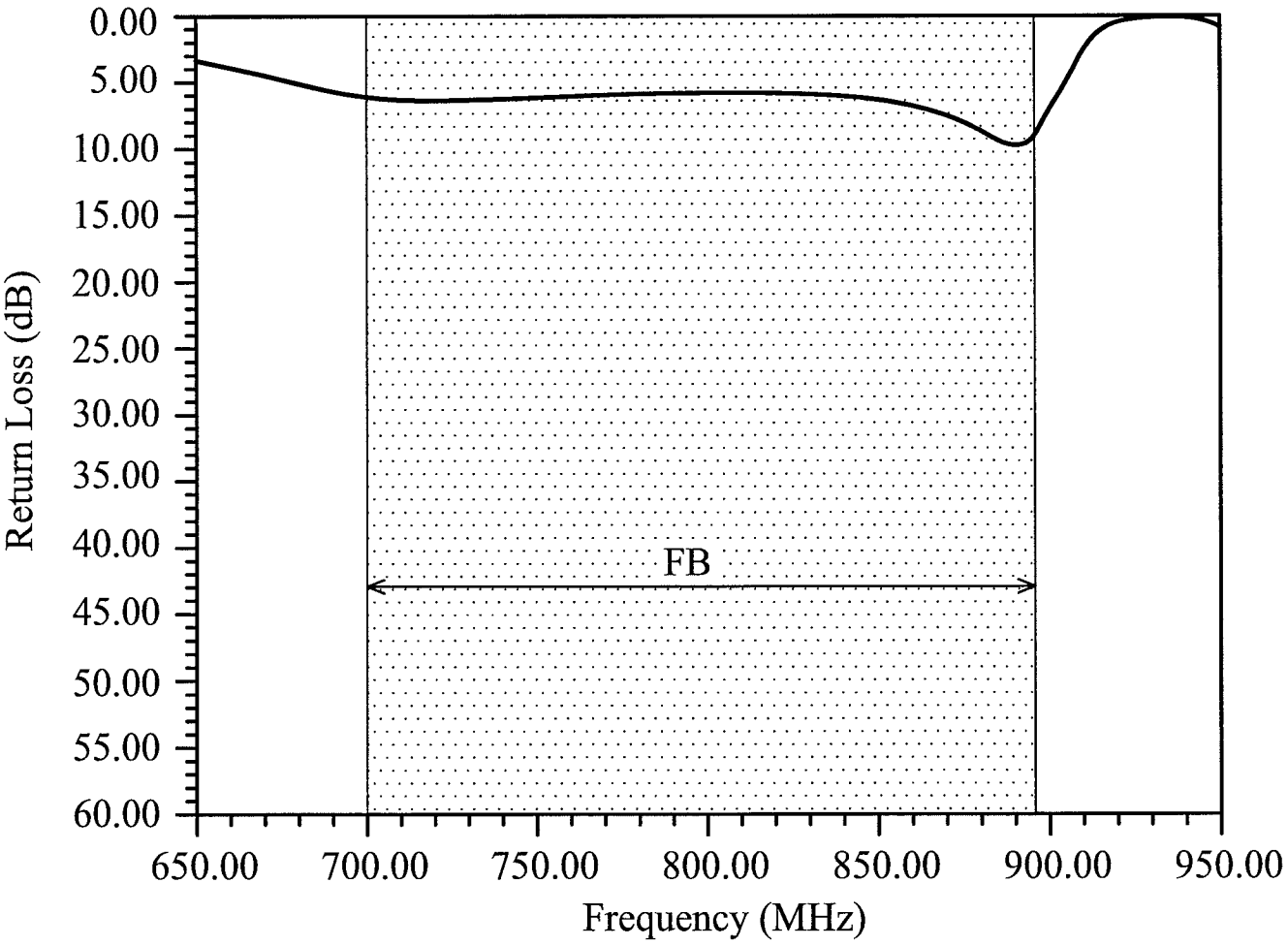
FIG. 2A is a diagram of return loss of a wideband antenna of a communication device according to an embodiment of the invention.

FIG. 2A is a diagram of return loss of the wideband antenna 110 of the communication device 100 according to an embodiment of the invention. The horizontal axis represents the operation frequency (MHz), and the vertical axis represents the return loss (dB). According to the measurement of FIG. 2A, the wideband antenna 110 can cover at least an operation frequency band FB from 698 MHz to 894 MHz. Within the aforementioned operation frequency band FB, the return loss of the wideband antenna 110 is from about 5.87 dB to about 9.23 dB. Accordingly, the wideband antenna 110 can support the multiband operation of LTE (Long Term Evolution) Band 12/Band 29/Band 5.

Figure 2B:
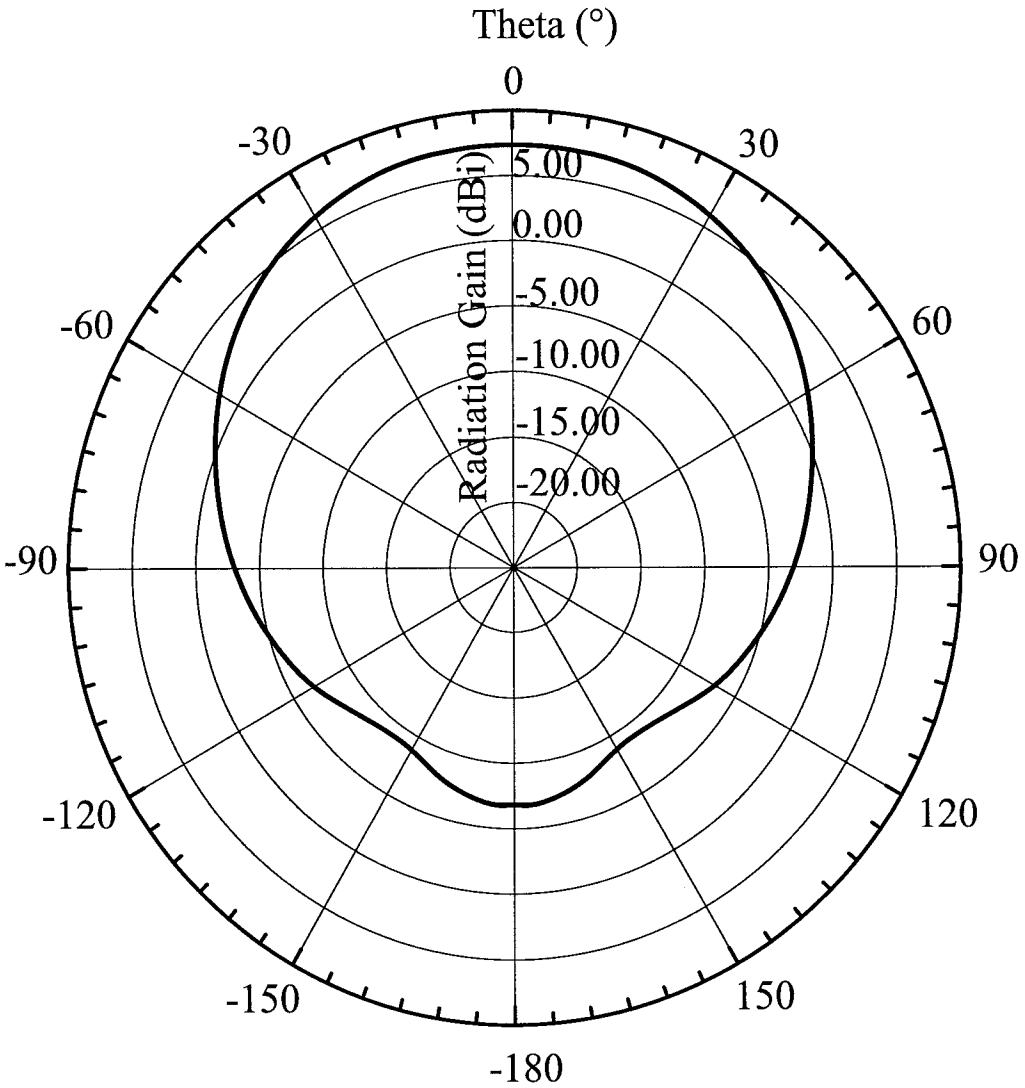
FIG. 2B is a radiation pattern of a wideband antenna of a communication device according to an embodiment of the invention.

FIG. 2B is a radiation pattern of the wideband antenna 110 of the communication device 100 according to an embodiment of the invention, which is measured at the frequency point of 824 MHz and along the XZ plane of FIG. 1A, FIG. 1B, and FIG. 1C. According to the measurement of FIG. 2B, the maximum radiation gain of the wideband antenna 110 reaches about 6.99 dBi in the direction of the +Z-axis. Furthermore, according to other measurement data, the maximum radiation gain of the wideband antenna 110 is from about 6.06 dBi to about 8.35 dBi, within the aforementioned operation frequency band FB, and it meets the requirements of practical application of general mobile communication.

Figure 3A:
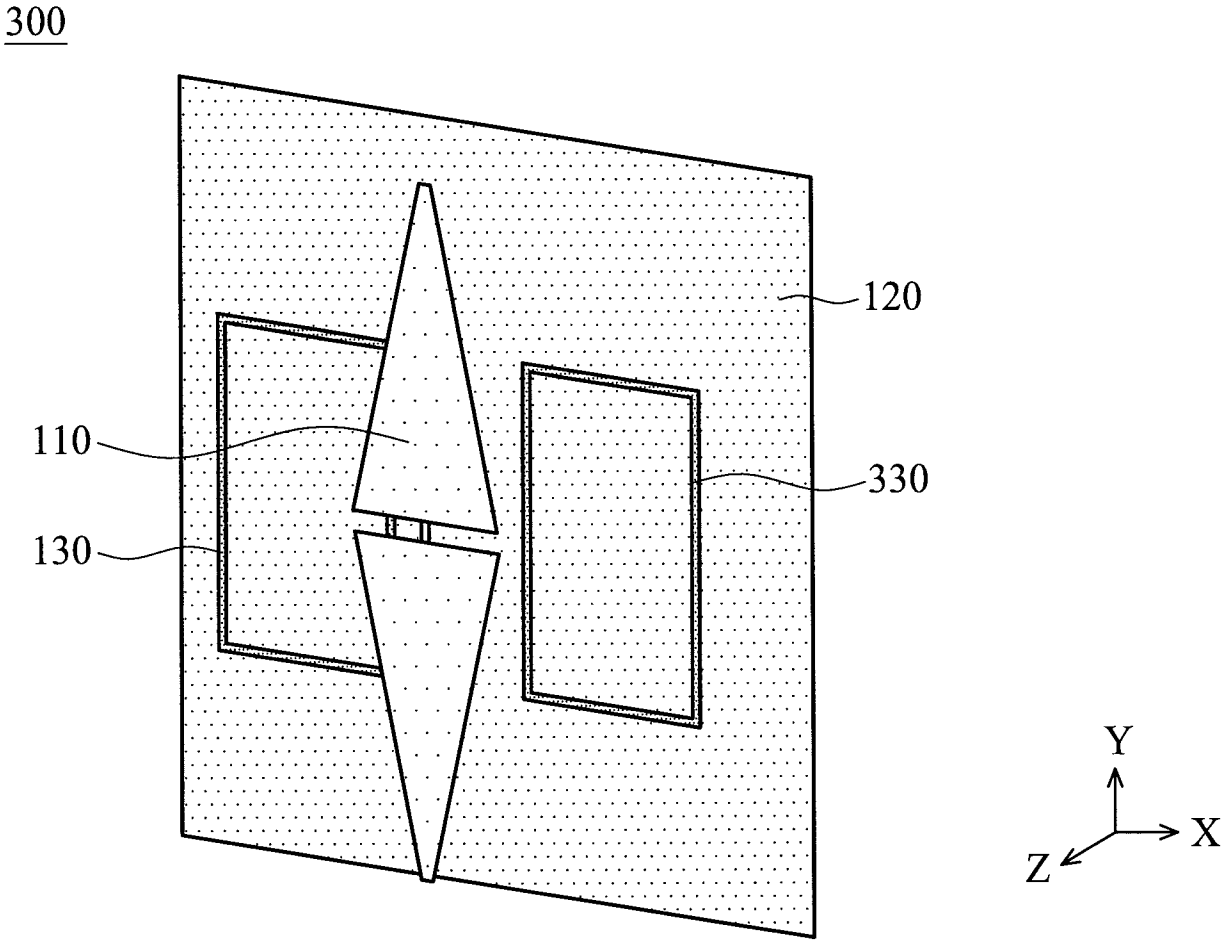
FIG. 3A is a perspective view of a communication device according to an embodiment of the invention.
Figure 3B:
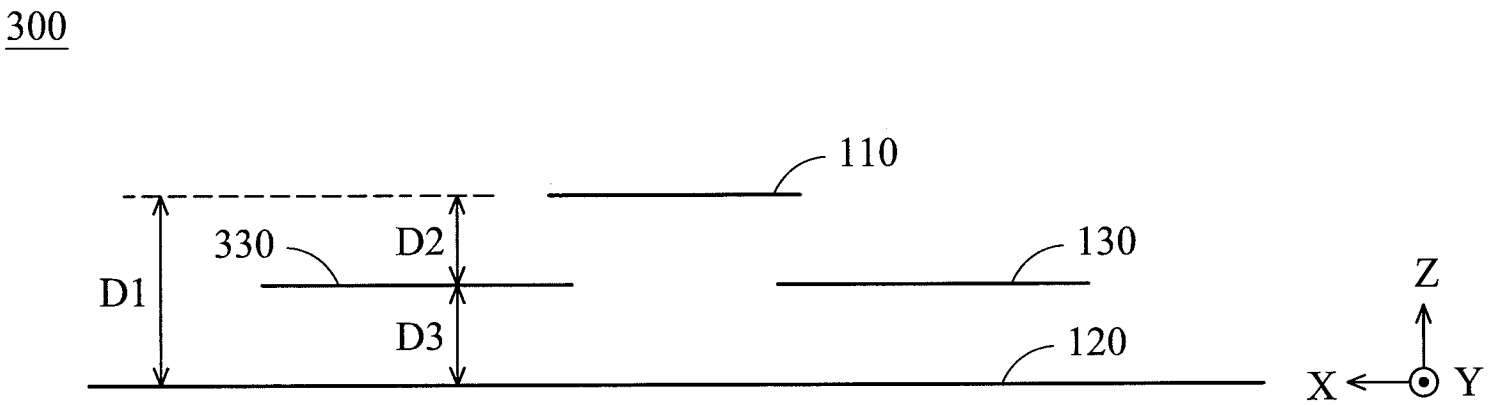
FIG. 3B is a side view of a communication device according to an embodiment of the invention.
Figure 3C:
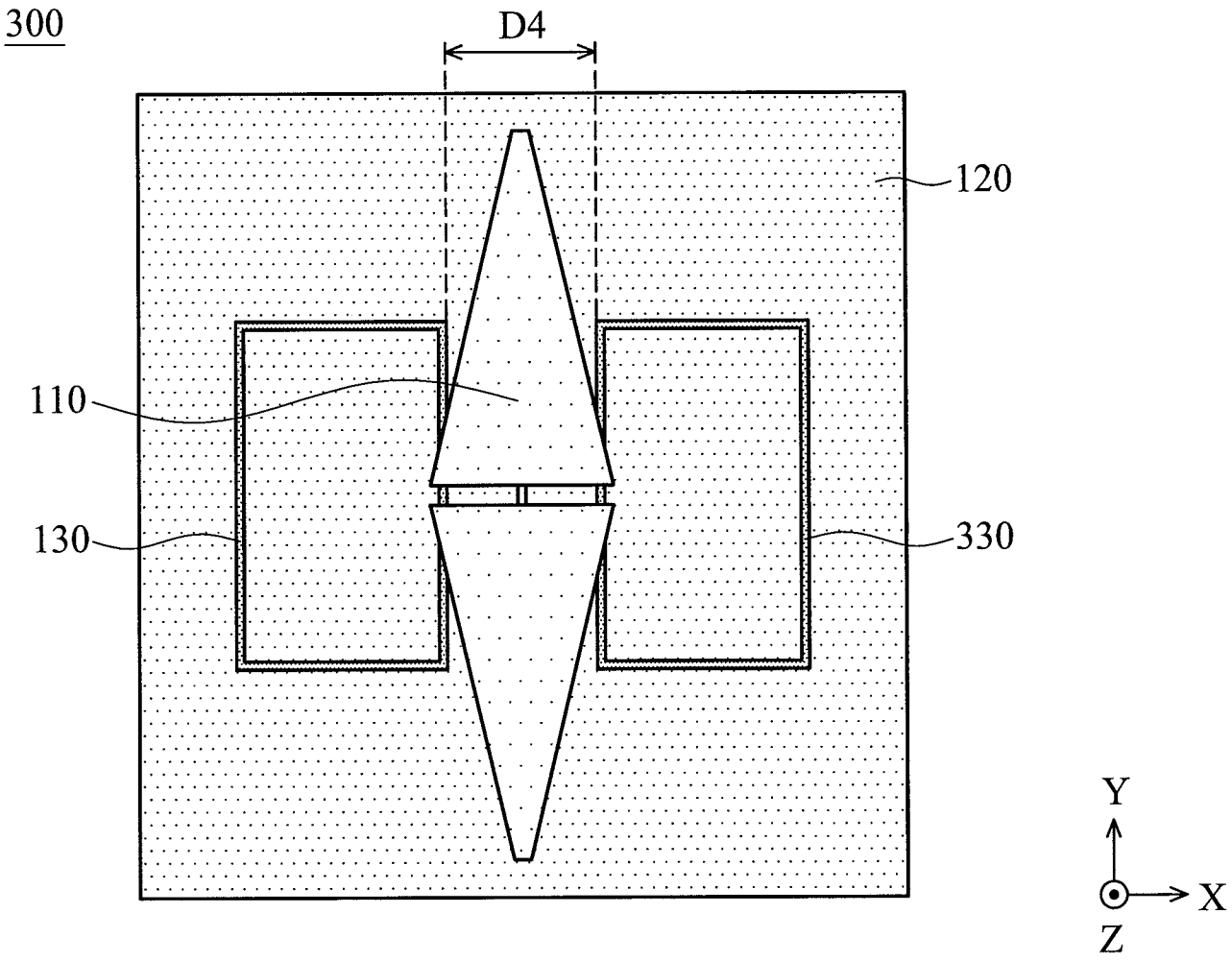
FIG. 3C is a top view of a communication device according to an embodiment of the invention.

FIG. 3A is a perspective view of a communication device 300 according to an embodiment of the invention. FIG. 3B is a side view of the communication device 300 according to an embodiment of the invention. FIG. 3C is a top view of the communication device 300 according to an embodiment of the invention. Please refer to FIG. 3A, FIG. 3B, and FIG. 3C together. FIG. 3A, FIG. 3B, and FIG. 3C are similar to FIG. 1A, FIG. 1B, and FIG. 1C. The difference between the two embodiments is that the communication device 300 further includes a second metal loop 330. The second metal loop 330 is disposed between the wideband antenna 110 and the reflector 120, and is completely separated from the first metal loop 130. The second metal loop 330 may have the same shape and size as the first metal loop 130. The second metal loop 330 and the first metal loop 130 may be arranged symmetrically with respect to the central line of the wideband antenna 110. In some embodiments, the wideband antenna 110, the reflector 120, the first metal loop 130, and the second metal loop 330 are not electrically connected to each other. Similarly, the distance D2 between the wideband antenna 110 and the second metal loop 330 is substantially equal to the distance D3 between the second metal loop 330 and the reflector 120. The distance D4 between the second metal loop 330 and the first metal loop 130 is from 0.04 to 0.2 wavelength of the central frequency of the operation frequency band of the wideband antenna 110, so as to optimize the impedance matching of the second metal loop 330, the first metal loop 130, and the wideband antenna 110. In some embodiments, the distance D4 between the second metal loop 330 and the first metal loop 130 is about 45 mm. According to practical measurements, the wideband antenna 110 of the communication device 300 can also cover the operation frequency band from 698 MHz to 894 MHz. Within the aforementioned operation frequency band, the maximum radiation gain of the wideband antenna 110 of the communication device 300 is from about 6.5 dBi to about 8.5 dBi. The second metal loop 330 helps to slightly improve the radiation performance of the wideband antenna 110. Other features of the communication device 300 of FIG. 3A, FIG. 3B, and FIG. 3C are similar to those of the communication device 100 of FIG. 1A, FIG. 1B, and FIG. 1C. Accordingly, the two embodiments can achieve similar levels of performance.

Figure 4A:
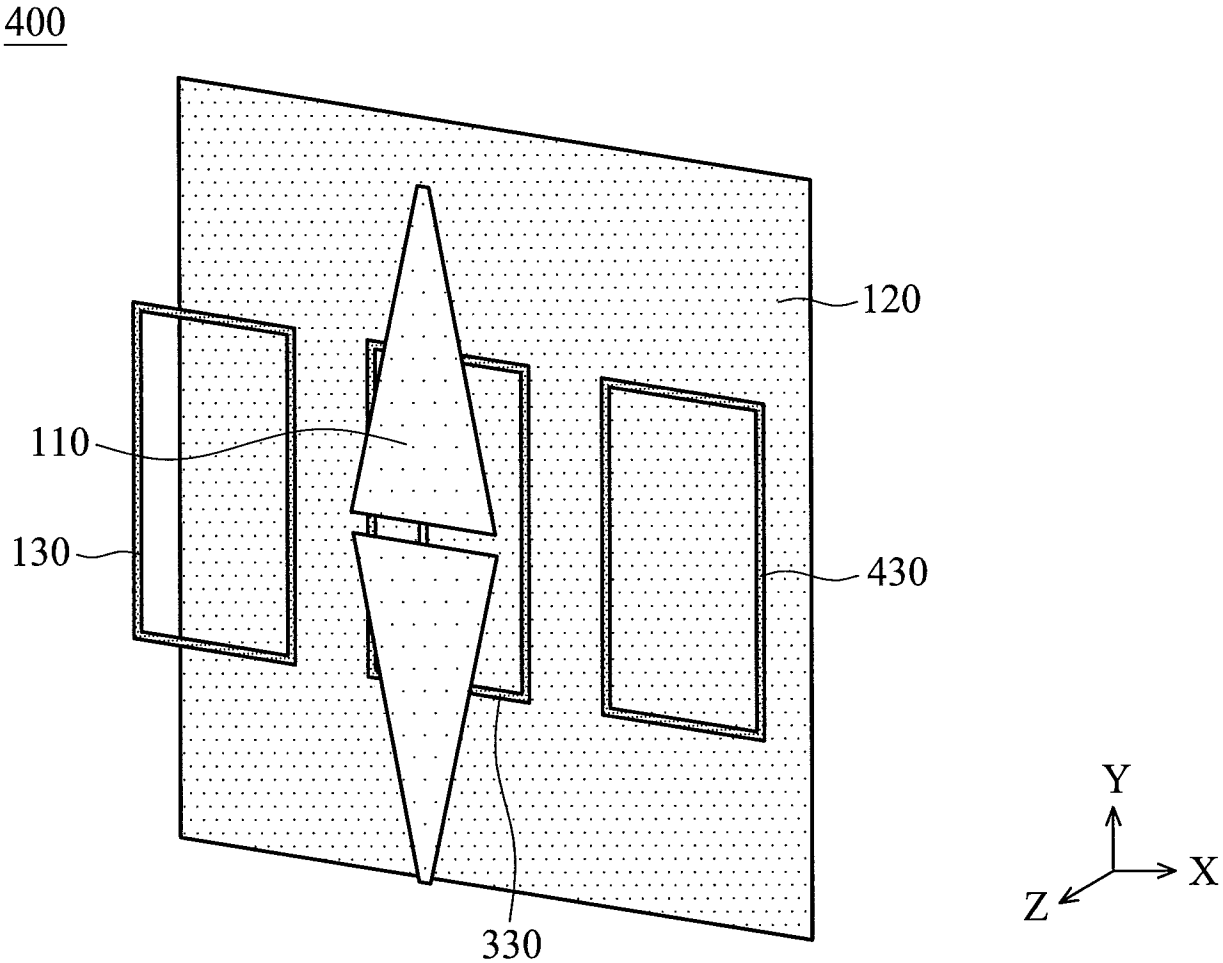
FIG. 4A is a perspective view of a communication device according to an embodiment of the invention.
Figure 4B:
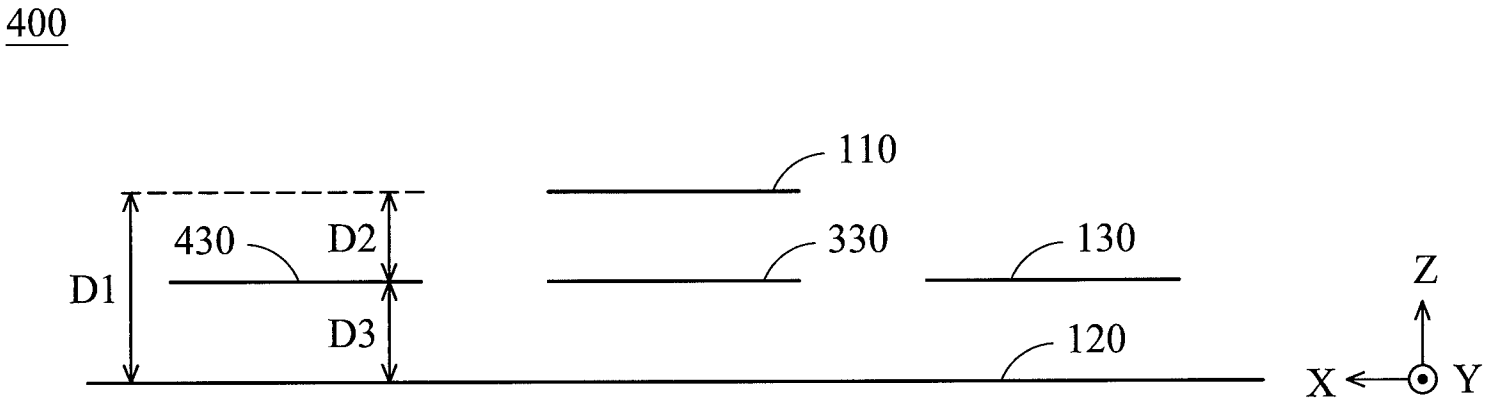
FIG. 4B is a side view of a communication device according to an embodiment of the invention.
Figure 4C:
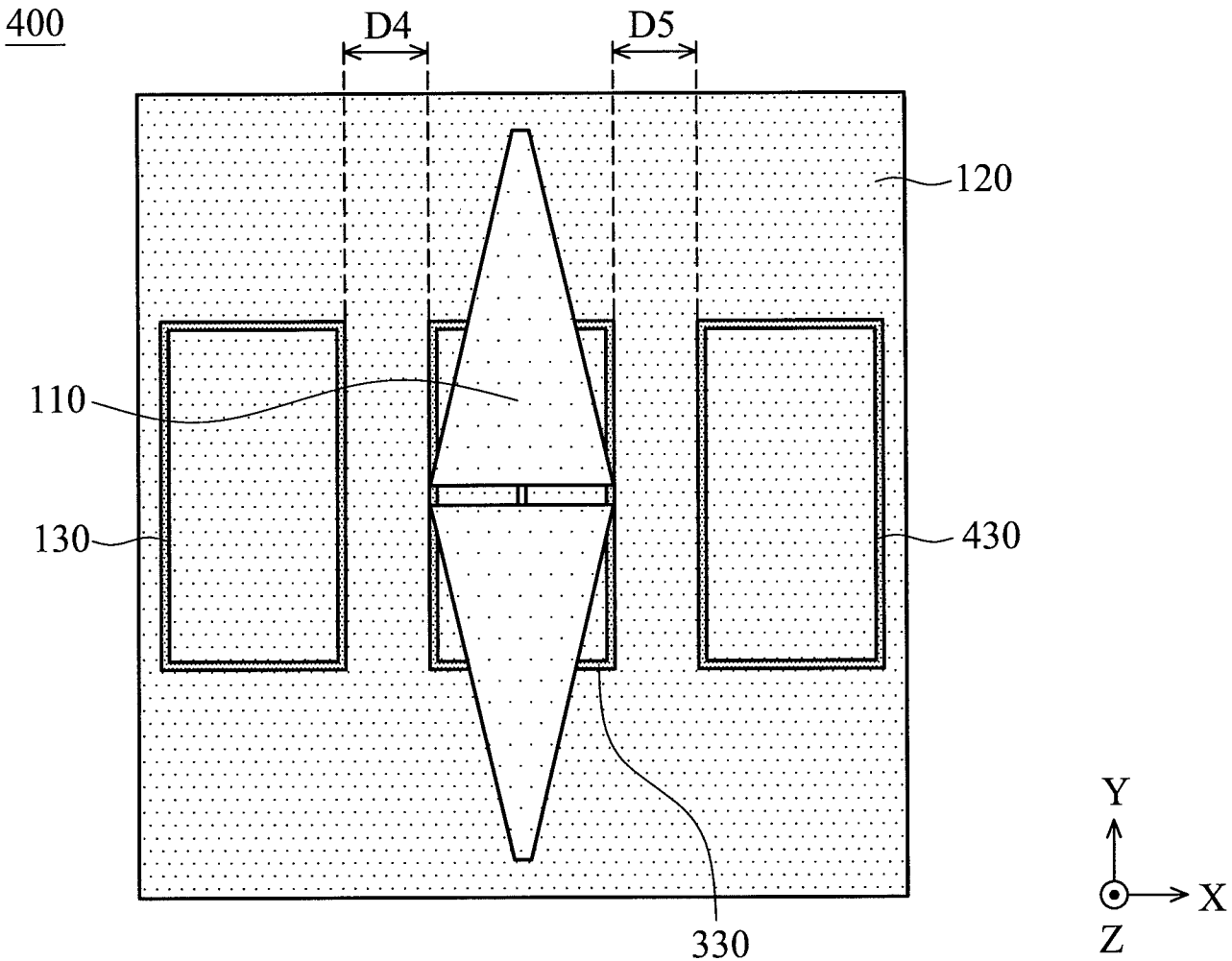
FIG. 4C is a top view of a communication device according to an embodiment of the invention.

FIG. 4A is a perspective view of a communication device 400 according to an embodiment of the invention. FIG. 4B is a side view of the communication device 400 according to an embodiment of the invention. FIG. 4C is a top view of the communication device 400 according to an embodiment of the invention. Please refer to FIG. 4A, FIG. 4B, and FIG. 4C together. FIG. 4A, FIG. 4B, and FIG. 4C are similar to FIG. 3A, FIG. 3B, and FIG. 3C. The difference between the two embodiments is that the communication device 400 further includes a third metal loop 430. The third metal loop 430 is disposed between the wideband antenna 110 and the reflector 120, and is completely separated from the first metal loop 130 and the second metal loop 330. The third metal loop 430 may have the same shape and size as the first metal loop 130 and the second metal loop 330. The third metal loop 430, the second metal loop 330, and the first metal loop 130 may be arranged symmetrically with respect to the central line of the wideband antenna 110, and the three metal loops may be arranged in the same straight-line or on the same plane. In some embodiments, the wideband antenna 110, the reflector 120, the first metal loop 130, the second metal loop 330, and the third metal loop 430 are not electrically connected to each other. Similarly, the distance D2 between the wideband antenna 110 and the third metal loop 430 is substantially equal to the distance D3 between the third metal loop 430 and the reflector 120. The distance D5 between the third metal loop 430 and the second metal loop 330 is from 0.04 to 0.2 wavelength of the central frequency of the operation frequency band of the wideband antenna 110, so as to optimize the impedance matching of the third metal loop 430, the second metal loop 330, and the wideband antenna 110. In some embodiments, the distance D4 between the second metal loop 330 and the first metal loop 130 is about 30 mm, and the distance D5 between the third metal loop 430 and the second metal loop 330 is about 30 mm. According to practical measurements, the wideband antenna 110 of the communication device 400 can also cover the operation frequency band from 698 MHz to 894 MHz. Within the aforementioned operation frequency band, the maximum radiation gain of the wideband antenna 110 of the communication device 400 is from about 6.45 dBi to about 8.42 dBi. The third metal loop 430 helps to slightly improve the radiation performance of the wideband antenna 110. Other features of the communication device 400 of FIG. 4A, FIG. 4B, and FIG. 4C are similar to those of the communication device 300 of FIG. 3A, FIG. 3B, and FIG. 3C. Accordingly, the two embodiments can achieve similar levels of performance.

In other embodiments, the proposed communication device further includes four or more metal loops, which are periodically distributed between the wideband antenna and the reflector, so as to reduce the distance between the wideband antenna and the reflector.

Figure 5A:
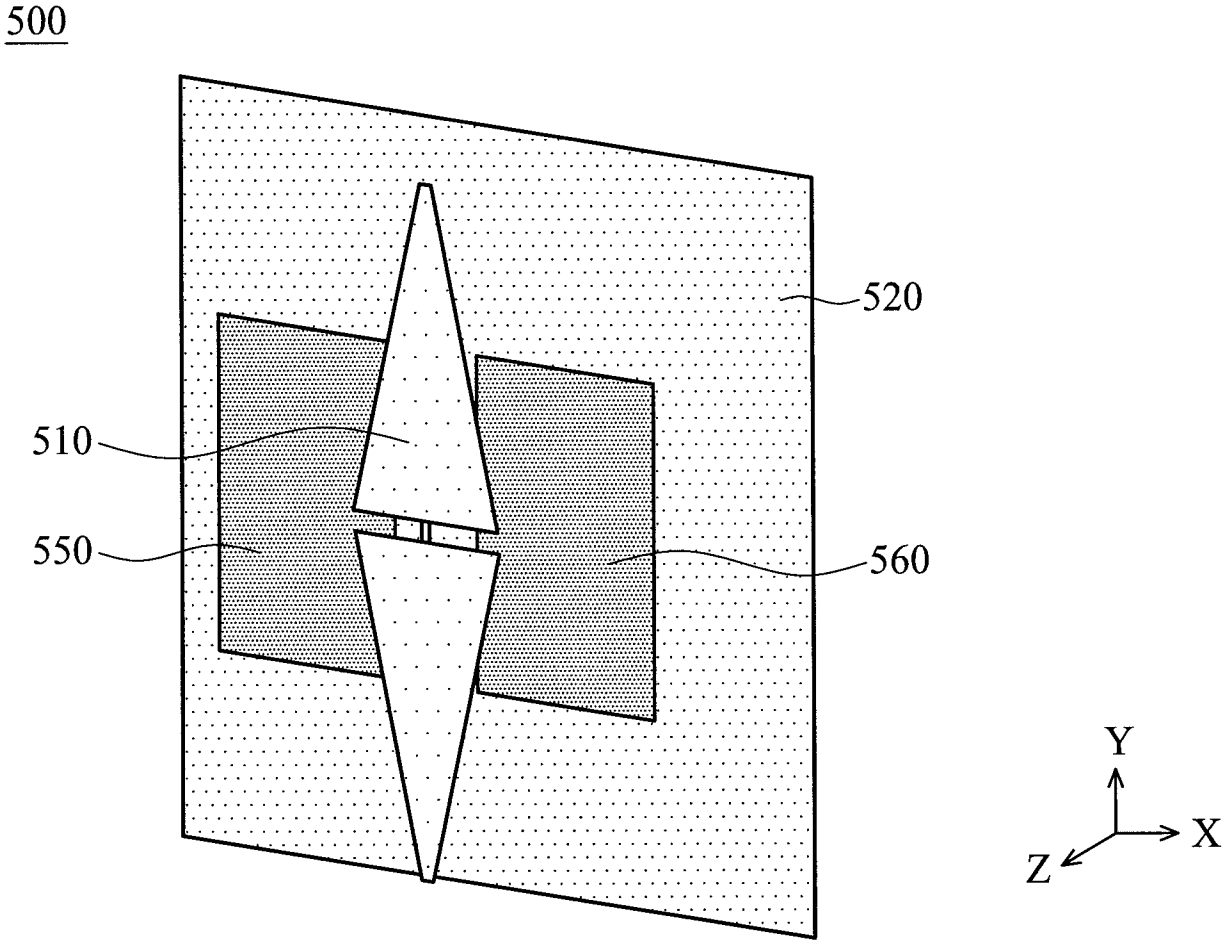
FIG. 5A is a perspective view of a communication device according to an embodiment of the invention.
Figure 5B:
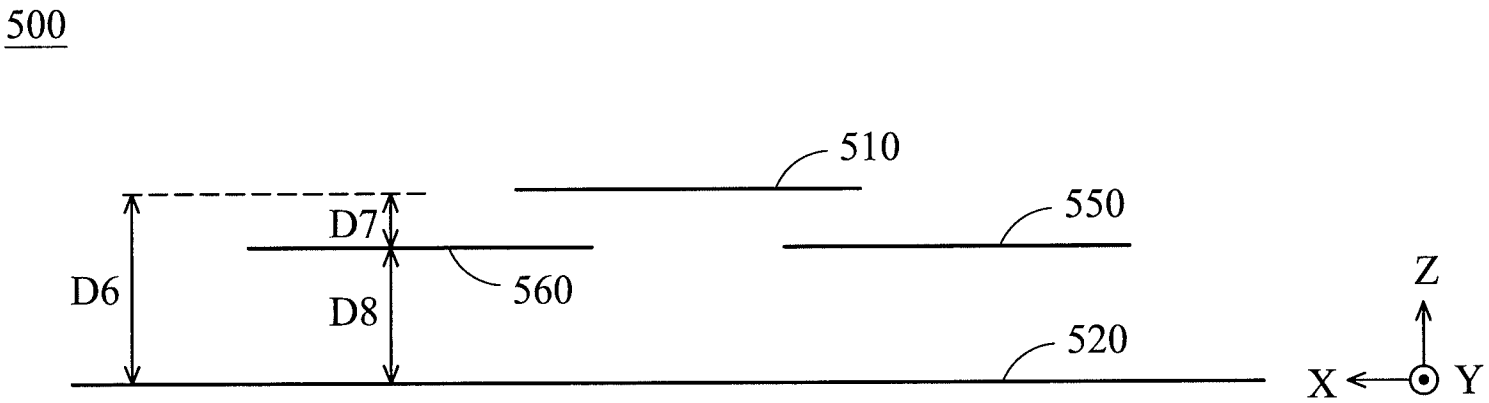
FIG. 5B is a side view of a communication device according to an embodiment of the invention.
Figure 5C:
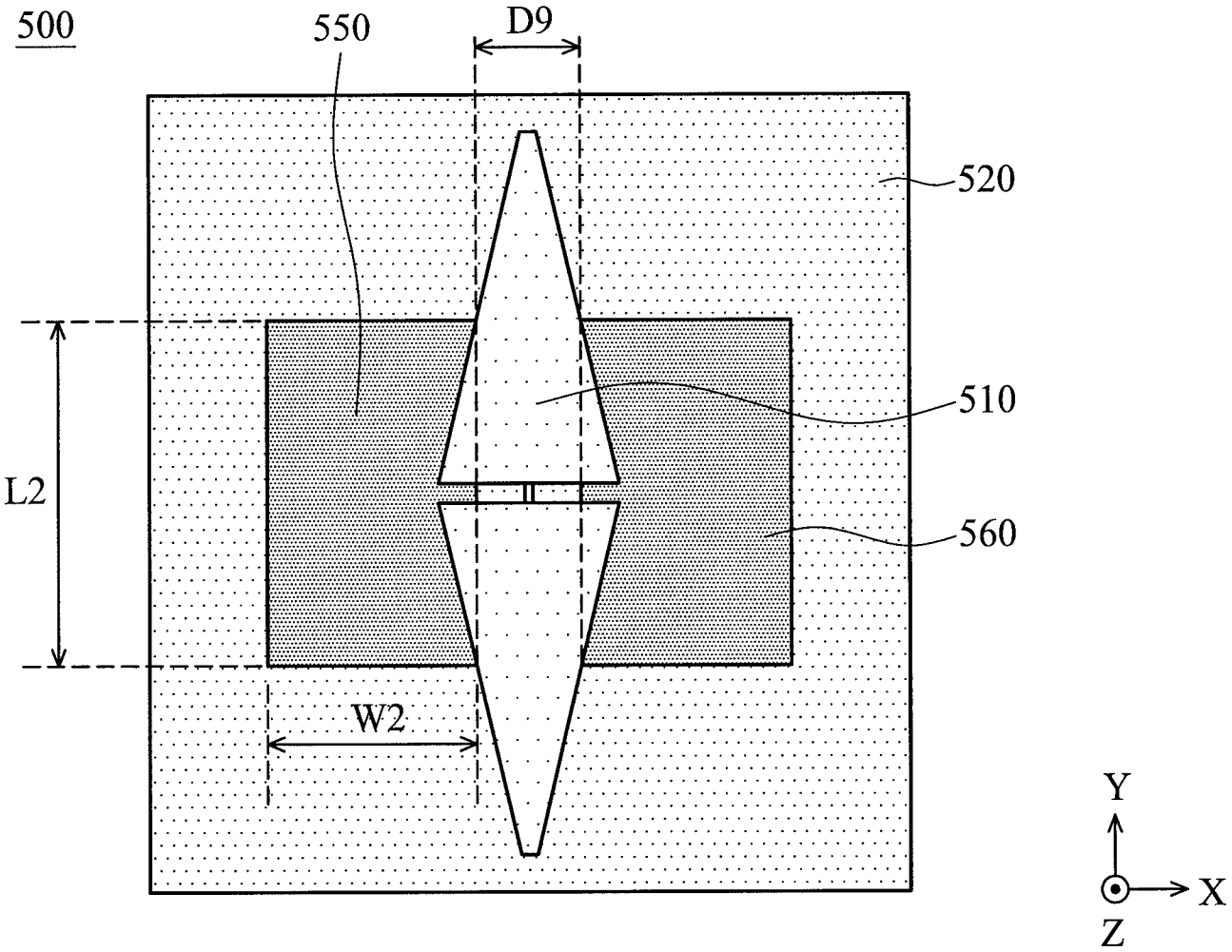
FIG. 5C is a top view of a communication device according to an embodiment of the invention.

FIG. 5A is a perspective view of a communication device 500 according to an embodiment of the invention. FIG. 5B is a side view of the communication device 500 according to an embodiment of the invention. FIG. 5C is a top view of the communication device 500 according to an embodiment of the invention. Please refer to FIG. 5A, FIG. 5B, and FIG. 5C together. The communication device 500 can be applied in a wireless access point or a mobile device. As shown in FIG. 5A, FIG. 5B, and FIG. 5C, the communication device 500 includes a wideband antenna 510, a reflector 520, a first metal piece 550, and a second metal piece 560. The first metal piece 550 may have the same shape and size as the second metal piece 560, and they may be completely separated from each other. In some embodiments, the wideband antenna 510, the reflector 520, the first metal piece 550, and the second metal piece 560 are not electrically connected to each other. It should be understood that the communication device 500 may further includes other components, such as a processor, an RF module, a battery module, and a housing although they are not displayed in FIG. 5A, FIG. 5B, and FIG. 5C.

The wideband antenna 510 is configured to cover an operation frequency band. The shape and type of the wideband antenna 510 are not limited in the invention. For example, the wideband antenna 510 may be a diamond-shaped dipole antenna. In alternative embodiments, the wideband antenna 510 is implemented with a bowtie-shaped dipole antenna, or one of a monopole antenna, a loop antenna, and a patch antenna. The reflector 520 is configured to reflect the radiation energy from the wideband antenna 510. The reflector 520 may be a square metal plane. Both the first metal piece 550 and the second metal piece 560 are disposed between the wideband antenna 510 and the reflector 520, and they are on the same plane and substantially parallel to the reflector 520. The first metal piece 550 and the second metal piece 560 are arranged symmetrically with respect to the central line of the wideband antenna 510. The first metal piece 550 and the second metal piece 560 are configured to reflect a portion of electromagnetic waves from the wideband antenna 510, and transmit the other portion of electromagnetic waves from the wideband antenna 510, thereby fine-tuning the phases of the electromagnetic waves and increasing the effective distance between the wideband antenna 510 and the reflector 520. With such a design, the distance D6 between the wideband antenna 510 and the reflector 520 can be shorter than 0.25 wavelength ($\lambda/4$) of a central frequency of the operation frequency band. For example, after the first metal piece 550 and the second metal piece 560 are added, the distance D6 between the wideband antenna 510 and the reflector 520 can be reduced to 0.125 wavelength ($\lambda/8$) of the central frequency of the operation frequency band or shorter. Therefore, the invention is suitable for application in a variety of small-size base stations or mobile communication devices.

The element shapes and element sizes of the communication device 500 may be as follows. The distance D7 between the wideband antenna 510 and the first metal piece 550 or the second metal piece 560 is shorter or equal to the distance D8 between the first metal piece 550 or the second metal piece 560 and the reflector 520. For example, the ratio of the distance D7 to the distance D8 may be about 3:7, 4:6, or 5:5, but it is not limited thereto. Each of the first metal piece 550 and the second metal piece 560 may substantially have a filled rectangular shape. Furthermore, in alternative embodiments, each of the first metal piece 550 and the second metal piece 560 includes a plurality of openings, or forms a grid-shaped structure or a lattice-shaped structure. The length L2 of each of the first metal piece 550 and the second metal piece 560 is shorter than 0.5 wavelength ($\lambda/2$) of the central frequency of the operation frequency band. Specifically, the length L2 of each of the first metal piece 550 and the second metal piece 560 is from 0.25 to 0.4 wavelength of the central frequency of the operation frequency band, for example, it can be 0.25 wavelength. The width W2 of each of the first metal piece 550 and the second metal piece 560 is from 0.025 to 0.2 wavelength of the central frequency of the operation frequency band, for example, it can be 0.2 wavelength. The distance D9 between the first metal piece 550 and the second metal piece 560 is from 0.04 to 0.2 wavelength of the central frequency of the operation frequency band. The above ranges of element sizes are calculated according to many experiments and simulation results, and they can optimize the impedance matching of the wideband antenna 510, the first metal piece 550, and the second metal piece 560. In some embodiments, the wideband antenna 510 has a total length of about 236.3 mm. The reflector 520 has a length of about 240 mm, and a width of about 240 mm. Each of the first metal piece 550 and the second metal piece 560 has a length L2 of about 107.4 mm, and a width W2 of about 71.8 mm. The distance D6 between the wideband antenna 510 and the reflector 520 is about 40 mm. The distance D7 between the wideband antenna 510 and the first metal piece 550 or the second metal piece 560 is about 11.4 mm. The distance D8 between the first metal piece 550 or the second metal piece 560 and the reflector 520 is about 28.6 mm. The distance D9 between the first metal piece 550 and the second metal piece 560 is about 40.9 mm.

Figure 6A:
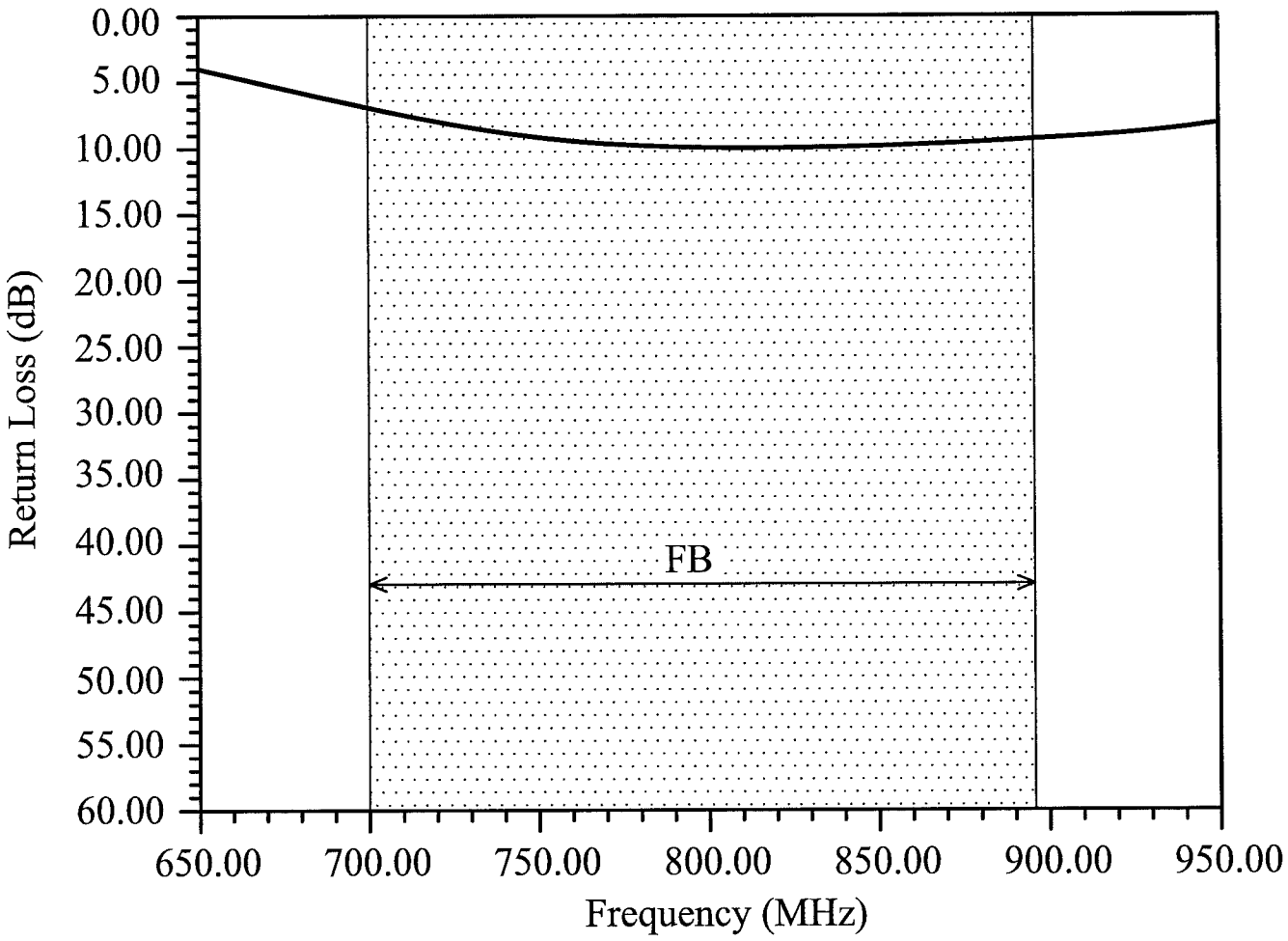
FIG. 6A is a diagram of return loss of a wideband antenna of a communication device according to an embodiment of the invention.

FIG. 6A is a diagram of return loss of the wideband antenna 510 of the communication device 500 according to an embodiment of the invention. The horizontal axis represents the operation frequency (MHz), and the vertical axis represents the return loss (dB). According to the measurement of FIG. 6A, the wideband antenna 510 can cover at least an operation frequency band FB from 698 MHz to 894 MHz. Within the aforementioned operation frequency band FB, the return loss of the wideband antenna 510 is from about 6.95 dB to about 9.93 dB. Accordingly, the wideband antenna 510 can support the multiband operation of LTE Band 12/Band 29/Band 5.

Figure 6B:
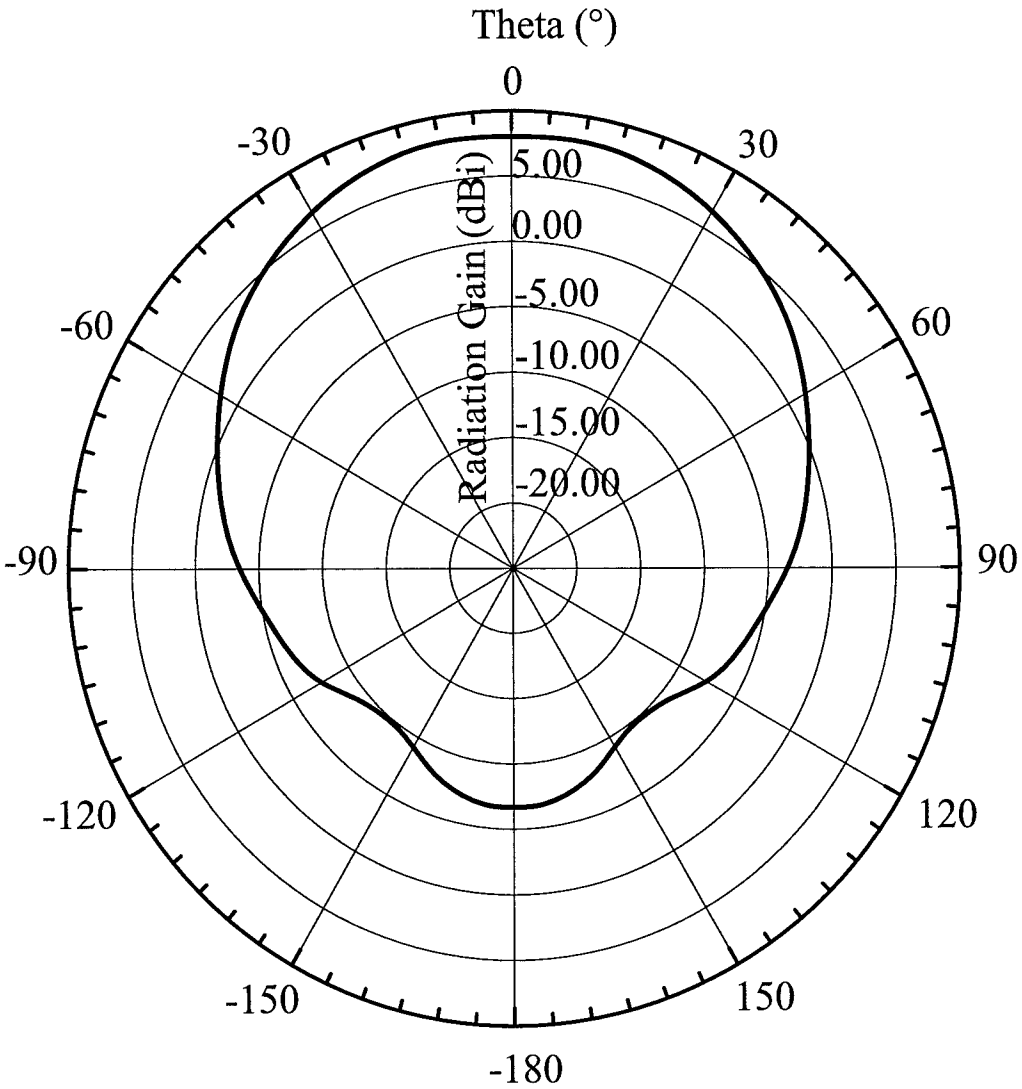
FIG. 6B is a radiation pattern of a wideband antenna of a communication device according to an embodiment of the invention.

FIG. 6B is a radiation pattern of the wideband antenna 510 of the communication device 500 according to an embodiment of the invention, which is measured at the frequency point of 824 MHz and along the XZ plane of FIG. 5A, FIG. 5B, and FIG. 5C. According to the measurement of FIG. 6B, the maximum radiation gain of the wideband antenna 510 reaches about 8.32 dBi in the direction of the +Z-axis. Furthermore, according to other measurement data, the maximum radiation gain of the wideband antenna 510 is from about 6.78 dBi to about 8.72 dBi, within the aforementioned operation frequency band FB, and it meets the requirements of practical application of general mobile communication.

In other embodiments, the proposed communication device further includes three or more metal pieces, which are periodically distributed between the wideband antenna and the reflector, so as to reduce the distance between the wideband antenna and the reflector.

The invention proposes a communication device. Compared with the conventional design, the invention has at least the following advantages: (1) the use of the metal loop or metal piece reduces the distance between the wideband antenna and the reflector to 0.25 wavelength of the central operation frequency; (2) because the metal loop or metal piece is positioned between the wideband antenna and the reflector, the invention does not additionally increase the total height of the communication device; (3) because the metal loop or metal piece has a length which is shorter than the length of the wideband antenna, the invention does not additionally increase the total size of the communication device; and (4) the manufacturing cost of the metal loop or metal piece is relatively low, and therefore the invention can be commercially produced and used in practical applications.

Note that the above element sizes, element parameters, element shapes, and frequency ranges are not limitations of the invention. An antenna designer can fine-tune these settings or values according to different requirements. It should be understood that the communication device of the invention is not limited to the configurations of FIGS. 1-6. The invention may merely include any one or more features of any one or more embodiments of FIGS. 1-6. In other words, not all of the features displayed in the figures should be implemented in the communication device and antenna system of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

While the invention has been described by way of example and in terms of the preferred embodiments, it is to be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A communication device, comprising:

a wideband antenna, covering an operation frequency band;

a reflector, reflecting radiation energy from the wideband antenna; and a first metal loop, disposed between the wideband antenna and the reflector;

wherein a distance between the wideband antenna and the reflector is shorter than 0.25 wavelength of a central frequency of the operation frequency band;

wherein the communication device further comprises:

a second metal loop, disposed between the wideband antenna and the reflector, wherein the second metal loop has the same shape and size as the first metal loop;

wherein a distance between the second metal loop and the first metal loop is from 0.04 to 0.2 wavelength of the central frequency of the operation frequency band.

2. The communication device as claimed in claim 1, wherein the reflector is a metal plane.

3. The communication device as claimed in claim 1, wherein the wideband antenna is a diamond-shaped dipole antenna.

4. The communication device as claimed in claim 1, wherein the distance between the wideband antenna and the reflector is reduced to 0.125 wavelength of the central frequency of the operation frequency band or shorter.

5. The communication device as claimed in claim 1, wherein a distance between the wideband antenna and the first metal loop is substantially equal to a distance between the first metal loop and the reflector.

6. The communication device as claimed in claim 1, wherein the first metal loop substantially has a hollow rectangular shape.

7. The communication device as claimed in claim 1, wherein a length of the first metal loop is shorter than 0.5 wavelength of the central frequency of the operation frequency band.

8. The communication device as claimed in claim 1, wherein a length of the first metal loop is from 0.25 to 0.4 wavelength of the central frequency of the operation frequency band.

9. The communication device as claimed in claim 1, wherein a width of the first metal loop is from 0.025 to 0.2 wavelength of the central frequency of the operation frequency band.

10. The communication device as claimed in claim 1, further comprising:

a third metal loop, disposed between the wideband antenna and the reflector, wherein the third metal loop has the same shape and size as the first metal loop.

11. The communication device as claimed in claim 1, wherein the operation frequency band is from 698 MHz to 894 MHz.

12. A communication device, comprising:

a wideband antenna, covering an operation frequency band;

a reflector, reflecting radiation energy from the wideband antenna;

a first metal piece, disposed between the wideband antenna and the reflector; and a second metal piece, disposed between the wideband antenna and the reflector;

wherein a distance between the wideband antenna and the reflector is shorter than 0.25 wavelength of a central frequency of the operation frequency band;

wherein the first metal piece and the second metal piece are floating and not electrically connected to the reflector;

wherein a distance between the first metal piece and the second metal piece is from 0.04 to 0.2 wavelength of the central frequency of the operation frequency band.

13. The communication device as claimed in claim 12, wherein the distance between the wideband antenna and the reflector is reduced to 0.125 wavelength of the central frequency of the operation frequency band or shorter.

14. The communication device as claimed in claim 12, wherein each of the first metal piece and the second metal piece substantially has a filled rectangular shape.

15. The communication device as claimed in claim 12, wherein a length of each of the first metal piece and the second metal piece is shorter than 0.5 wavelength of the central frequency of the operation frequency band.

16. The communication device as claimed in claim 12, wherein a length of each of the first metal piece and the second metal piece is from 0.25 to 0.4 wavelength of the central frequency of the operation frequency band.

17. The communication device as claimed in claim 12, wherein a width of each of the first metal piece and the second metal piece is from 0.025 to 0.2 wavelength of the central frequency of the operation frequency band.

* * * * *